US007334824B2

(12) United States Patent
Sundberg et al.

(10) Patent No.: US 7,334,824 B2
(45) Date of Patent: Feb. 26, 2008

(54) DOOR LEVER LOCK

(75) Inventors: Brian Sundberg, Chester, NH (US); Kenneth Kaiser, Libertyville, IL (US)

(73) Assignee: KidCo, Inc., Libertyville, IL (US)

( * ) Notice: Subject to any disclaimer, the term of this patent is extended or adjusted under 35 U.S.C. 154(b) by 239 days.

(21) Appl. No.: 10/963,311

(22) Filed: Oct. 12, 2004

(65) Prior Publication Data

US 2006/0076787 A1 Apr. 13, 2006

(51) Int. Cl.
*E05B 3/00* (2006.01)

(52) U.S. Cl. ..... 292/336.3; 292/1; 292/DIG. 2

(58) Field of Classification Search ..... 292/336.3, 292/1 X, DIG. 2 X; 70/455, 424, 428, 209
See application file for complete search history.

(56) References Cited

U.S. PATENT DOCUMENTS 2,997,089 A * 8/1961 Amdur et al. ..... 16/402
3,245,240 A * 4/1966 De Forrest ..... 70/209
3,585,827 A * 6/1971 Dominguez ..... 70/416
4,082,351 A 4/1978 Chrones
4,503,692 A * 3/1985 Grint ..... 70/418
4,570,470 A * 2/1986 Gray, Sr. ..... 70/428
4,629,229 A * 12/1986 Correnti et al. ..... 292/246
4,798,069 A * 1/1989 DeForrest, Sr. ..... 70/428
4,899,564 A * 2/1990 Gilbert ..... 70/428
5,423,583 A * 6/1995 Crockom ..... 292/289
6,231,091 B1 * 5/2001 Gleason et al. ..... 292/34
6,371,155 B1 * 4/2002 Balocca ..... 137/377
6,861,602 B2 * 3/2005 Juga ..... 200/341

FOREIGN PATENT DOCUMENTS

GB 2088463 A * 6/1982

* cited by examiner

*Primary Examiner*—Jennifer H. Gay
*Assistant Examiner*—Mark Williams
(74) *Attorney, Agent, or Firm*—DLA Piper US LLP; R. Blake Johnston

(57) ABSTRACT

A child safety lock for a lever door handle is rotatably mounted on a first side of a door and is biased in a first position. The child safety lock has a holder adapted to engage the door handle so that rotating the door handle rotates the holder. A cover is pivotally mounted on the holder and is shaped to cover the holder. A lock assembly is disposed in a vicinity of the door handle. The lock assembly selectively engages the cover for preventing rotation of the cover.

19 Claims, 7 Drawing Sheets

42a
52a
54
32
50a
48a
30
68
46a
44a
60
18
36
58
66
64
20
12
A
63
56
68
52b
40
68
48b
42b
38
62
50b
72
34
70
24
46b
44b 76
90
150
74
84
26
80
86
82
78
42a
52a
32
24
A
58
60
62
30
46b
44b
34

DOOR LEVER LOCK

FIELD OF THE INVENTION

The present invention is generally related to child safety door locks and, in particular, to a child safety lock for lever door handles.

BACKGROUND OF THE INVENTION

Known lever door handles or knobs operate by turning the handle on the door which removes a latch from a recess in the door jamb. While sometimes these lever handles have locks, the locks are frequently automatically unlocked when the door handle is rotated from the interior side of the door (i.e. inside of the building or room). Thus, the only way to prevent unlocking and opening of the door by a small child is to prevent turning of the door handle.

One such safety device, offered by G2 Products of Franklin, Wis., has a collar and clip that fit over a lever door handle located close to a door jamb. The collar has two arms that extend radially relative to the axis of rotation of the handle. When a child attempts to rotate the handle, the arms collide with the door jamb preventing rotation of the door handle. This design, however, does not work with French or double doors where no door jamb is positioned close to the door handle.

In addition, this type of safety lock will only provide entry from the opposite side of the door when opposing lever door handles on the same door operate independently. For door handles on the opposite sides of a door that must rotate simultaneously in order to open the door, this kind of safety lock will prevent entry from both sides of the door. With such a door handle arrangement, turning the lever handle from the outside of the door would also turn the lever handle on the inside of the door and, as a result, the lock would be broken if an individual forced the handle to turn so as to gain entry.

Furthermore, this type of lock must be manually reset every time an individual passes through the door. This may be problematic in that some individuals, such as visitors or older children, may forget to reset the lock.

Another known child safety door lock, offered by Safety 1$^{st}$ of Canton, Mass., includes a collar that is mounted to the door and fits around the axial shank of the lever door handle. This design has a spring loaded button that is placed along the circumference of the collar and biased outward from the collar and door surface. The button blocks the rotational pathway of the lever door handle so that the handle cannot be rotated unless the button is depressed and slid on the collar away from the handle. The device features an override, however, that permits the door handle to be turned, even when the lock is activated, if a turning force of over approximately five kilograms is applied. This level of force is believed to be greater than what a young child could provide and permits entry into the room from the opposite side of the door by adults and older children.

A disadvantage of this lock, however, is that the door handle mechanism must be disassembled to install the product. In addition, this type of lock also must be manually reset every time an individual passes through the door.

Another child safety door lock on the market is the LEVER LOK product offered by Mommy's Helper, Inc. of Witchita, Kans. This product features a bowl-shaped cover or shield that is mounted on the door and surrounds the sides and bottom of a door lever handle. As a result, the door lever handle may only be activated by reaching down through the open top of the cover. This prevents young children from accessing the door lever handle due to their limited reach. A disadvantage of this arrangement, however, is that the door latch plate must be disassembled for the product to be installed. In addition, the effectiveness of the product is limited by the height of the door lever handle.

Accordingly, it is an object of the present invention to provide a child safety lock for lever door handles.

It is another object of the present invention to provide a child safety lock that permits a door to be locked on one side while unlocked on the other side.

It is another object of the present invention to provide a child safety lock that automatically resets.

It is still another object of the present invention to provide a child safety lock for a door handle that may be installed without disassembling the door handle.

These and other objects and advantages will be apparent from the following specification.

SUMMARY OF THE INVENTION

The present invention is directed to a lever door handle child safety lock that locks the side of the door where a child is located while permitting adults to open the door from the opposite side.

More specifically, in accordance with the present invention, a child safety lock for a lever door handle is rotatably mounted on a first side of a door and is biased in a first position. The child safety lock has a holder adapted to engage the lever door handle so that rotating the door handle rotates the holder. A cover is pivotally mounted on the holder and is shaped to cover the holder. A lock assembly is disposed in a vicinity of the door handle. The lock assembly selectively engages the cover for preventing rotation of the cover.

The lock assembly includes a lock housing that is mounted above the cover. An activator including a latch and a button slides within the housing and is biased by a spring so that the latch engages an indent formed in the cover when the device is locked. The button extends through an opening in the front of the lock housing and is lifted up by a user to raise the latch out of the cover indent. As a result, the device is unlocked so that the cover and holder may be rotated to open the door.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
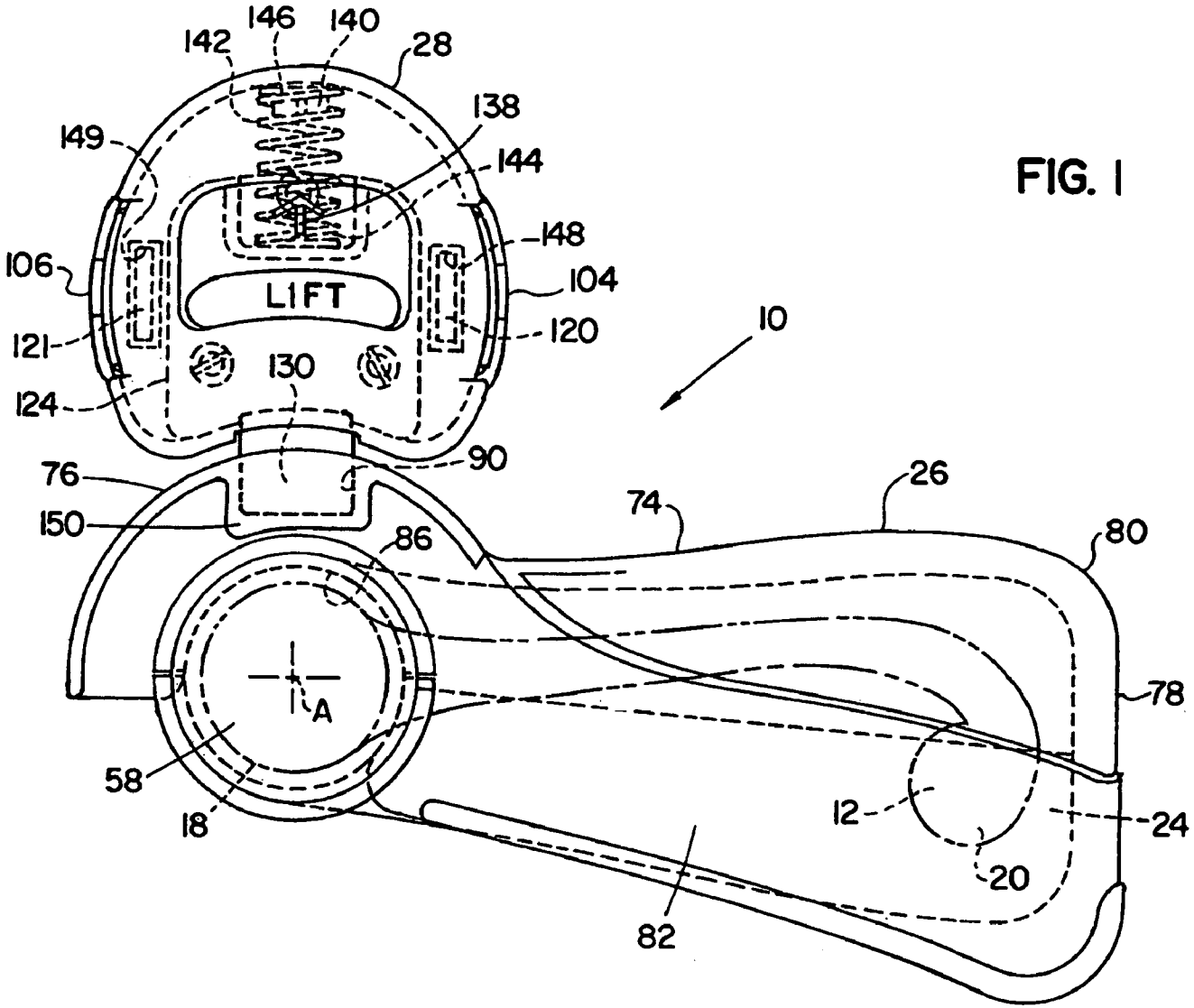
FIG. 1 is a front, elevational view of an embodiment of the child safety lock of the present invention in a locked condition.
Figure 2:
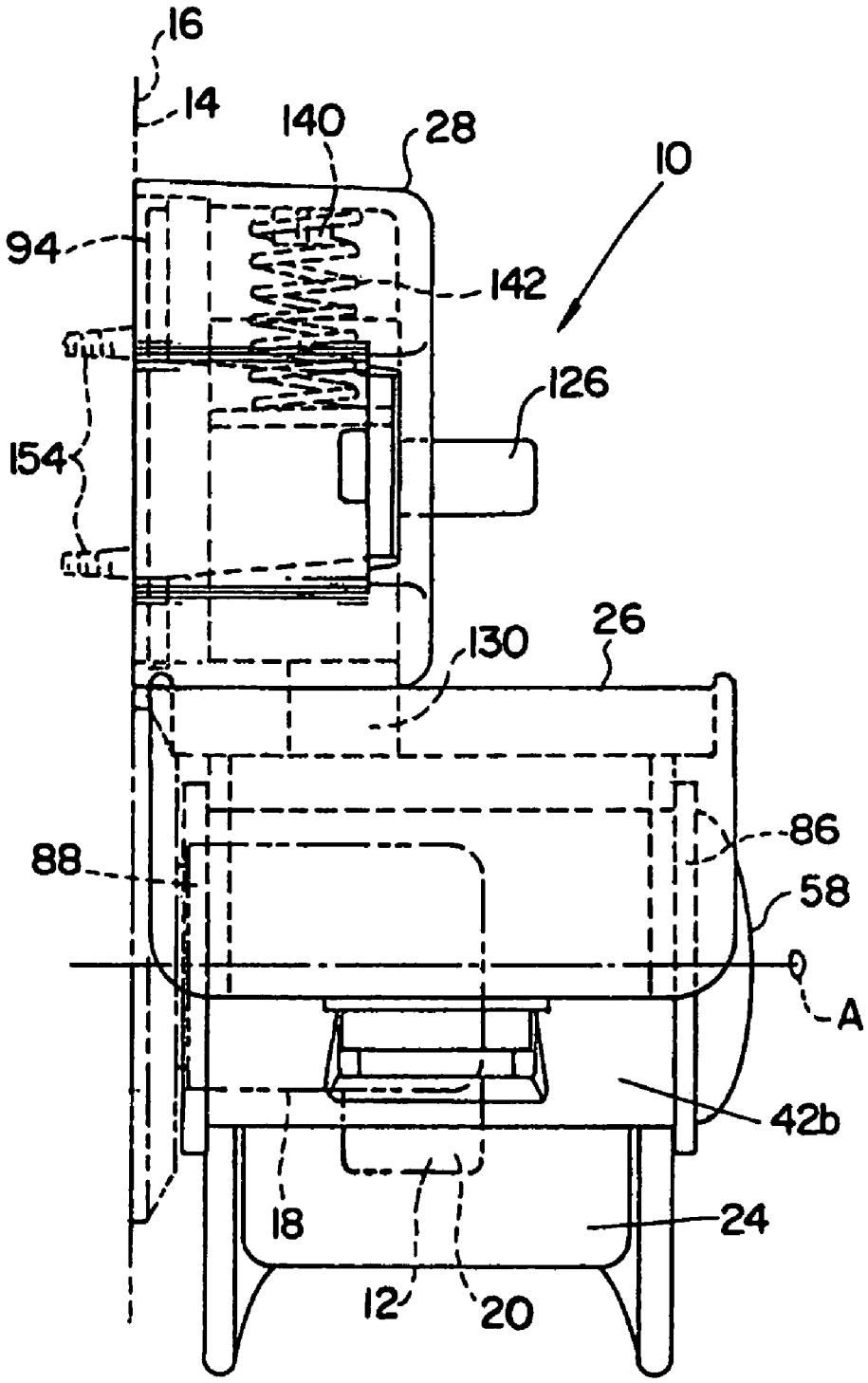
FIG. 2 is a left side, elevational view of the child safety lock of FIG. 1.

As shown in FIGS. 1 and 2, a child safety lock, generally indicated at 10, is mounted on a lever door handle 12 that itself is mounted on a first side 14 (FIG. 2) of a door 16 that also has an opposite, second side (not shown). It will be understood that the invention can be used for a door with a door handle on only one side of the door or a door with a second handle on the second side of the door. The handle on the second side can be a lever door handle, a round door knob or any other type of door handle. The invention also works whether or not the second door handle operates independently of the door handle 12 on the first side of the door as explained below.

As also illustrated in FIGS. 1 and 2, the lever door handle 12 has a shank 18 extending from the first side 14 of the door and an elongated lever member 20 extending from a distal end of the shank and generally parallel to the door.

Referring to FIG. 1, the child safety lock 10 has a lever holder 24 engaging, and substantially enclosing, the door handle 12 so that both the holder and the lever member may be rotated about an axis of rotation 'A'. A cover 26 is shaped to cover the holder and is pivotally mounted on the holder 24 so that it pivots about axis 'A'. As illustrated in FIG. 1, the handle 12 is biased in a first position, or counter-clockwise, so that the holder 24 remains covered by cover 26. A lock assembly 28 is disposed in a vicinity of the door handle 12 where, as will be explained in greater detail below, it can engage the cover 26 in order to lock it in place.

Figure 3:
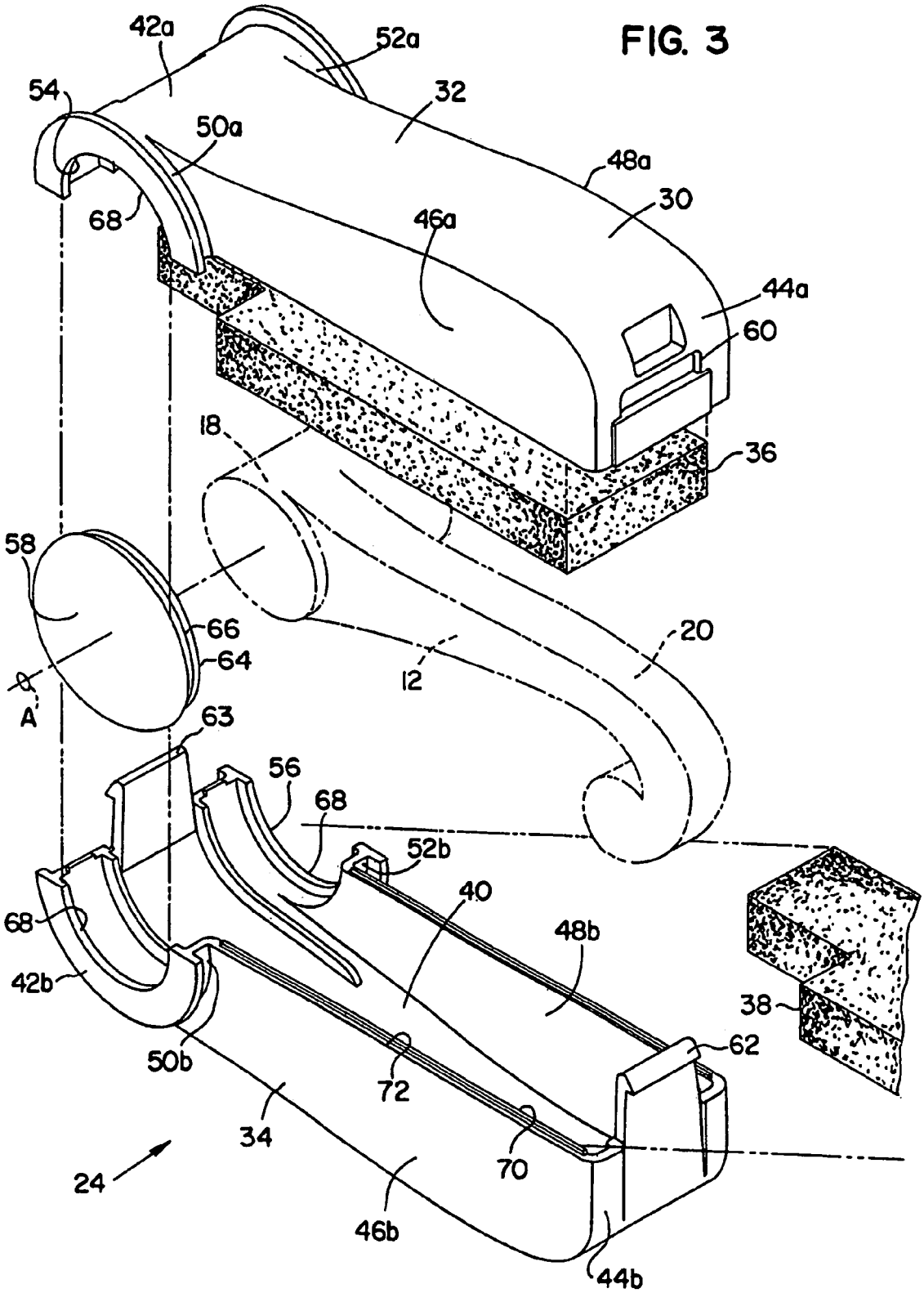
FIG. 3 is an exploded view of the lever holder of the child safety lock of FIG. 1;.
Figure 4:
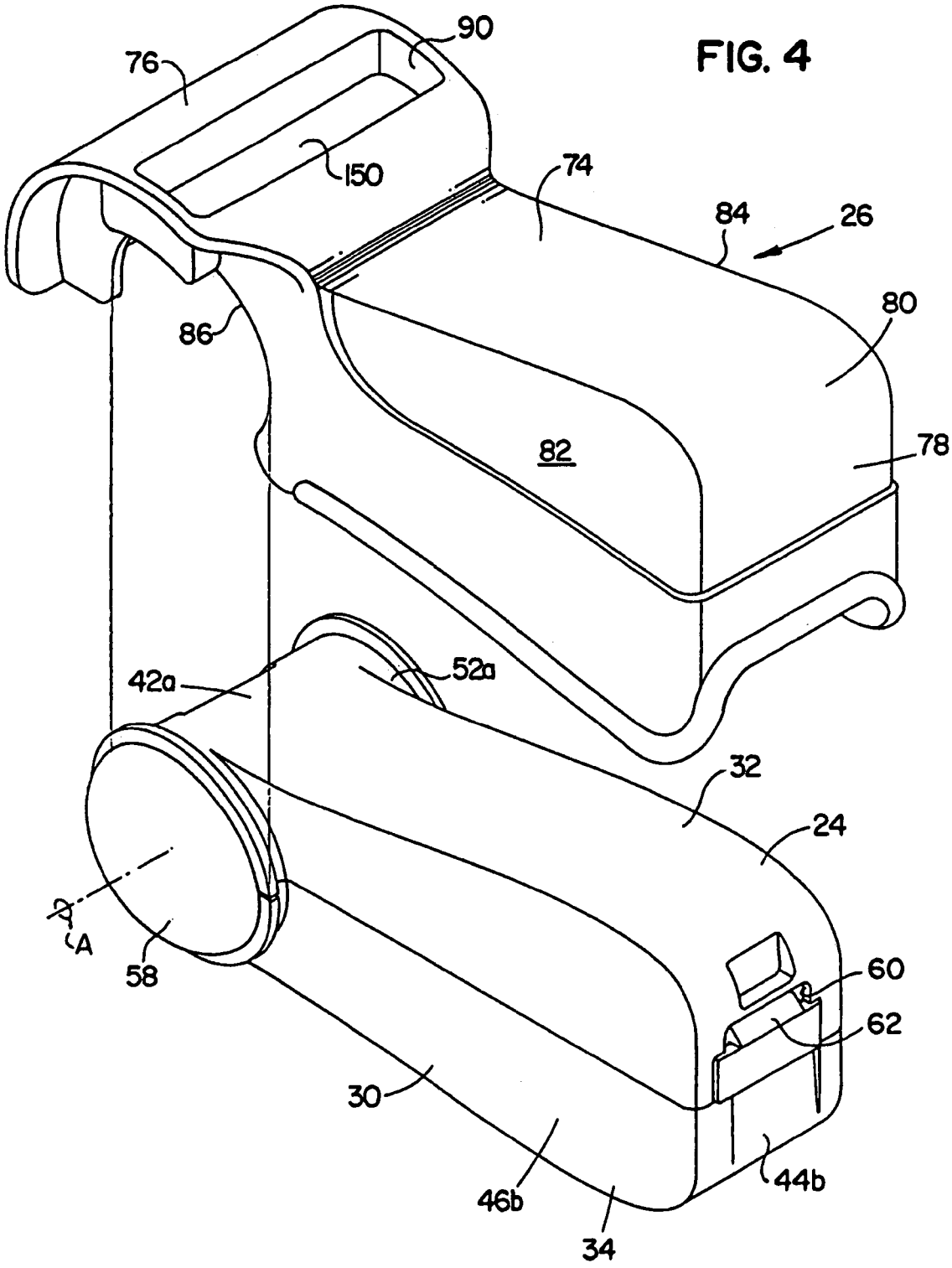
FIG. 4 is a partially exploded view of the cover and holder of the child safety lock of FIG. 1.

As shown in FIGS. 3 and 4, the holder 24 has an elongated body or housing 30 cooperatively formed by an upper half 32, that fits over a top of the lever member 20, interlocking with a lower half 34 that fits over the bottom of the lever member 20. A cushion pad 36 and 38 is made of a soft, compressible material, such as foam rubber, that will not scratch or damage the lever member 20. The pads 36, 38 are placed between sides of the lever member 20 and the interior surfaces 40 of the holder halves 32, 34. The pads 36, 38 provide a snug fit for the lever member 20 within the assembled holder 24 in addition to preventing damage to the lever member.

As illustrated in FIGS. 3 and 4, the housing 30 has a generally cylindrically shaped first end composed of portions 42*a* and 42*b*, an opposing distal, second end composed of portions 44*a* and 44*b*, and sidewalls 46*a*, 46*b*, 48*a* and 48*b* formed by halves 32, 34. A lip 70 is provided on a top edge 72 of one of the halves to mate with a groove (not shown) on the sidewall of the opposite half in order to maintain alignment of the sidewalls 46*a*, 46*b*, 48*a* and 48*b*. The cylindrical end of the holder 24 has curvilinear extensions 50*a*, 50*b*, 52*a* and 52*b* extending laterally in opposite directions and outward from the sidewalls of the holder. Each end of an extension defines one of two opposing circular openings 54, 56.

The holder 24 also has a key-hole cover or cap 58 dimensioned to alternatively cover a selected one of the openings 54, 56. A rim 64 on the cap has a groove 66 engaging a circular edge 68 on cylindrical end 42 that defines either opening 54, 56. Thus, either of the openings 54, 56 can receive the shank 18 of the door handle 12 while the other opening 54 or 56 can receive the cap 58. With this configuration, the holder 24 is adaptable to alternatively fit on either a left-hand or a right-hand lever handle.

As shown in FIGS. 3 and 4, the upper half 32 of the housing 30 has a locking slot 60 at housing end 44*a* for receiving a hooked locking tab 62 positioned on half 34 in order to secure the two halves 32 and 34 to each other. The other end 42*a* of half 32 also has a locking slot (not shown) that receives tab 63 positioned on the end 42*b* of half 34.

It will be appreciated that although the holder 24 encloses the entire lever member 20 (i.e. none of the lever member 20 is visible from the exterior of the holder 20) configurations that merely enclose a substantial portion, or even a small part, of the lever member 20 are still within the scope of the invention. Holder 24, however, must engage the lever member 20, rotate with the lever member and provide a way for cover 26 to attach to, and pivot relative to the holder 24 while preventing operable access to the lever member 20.

Figure 5:
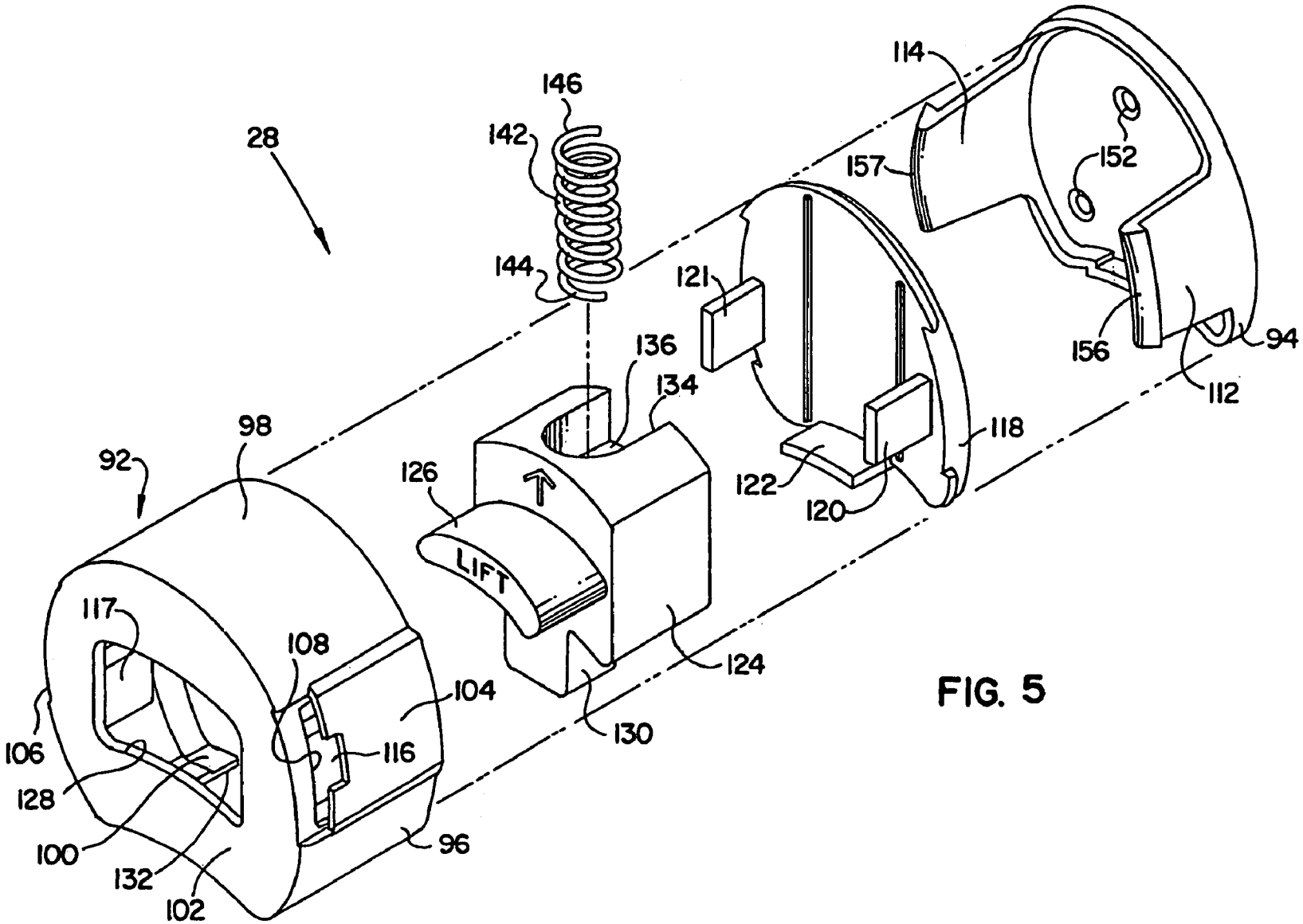
FIG. 5 is an exploded view of the lock assembly of the child safety lock of FIG. 1.

As shown in FIGS. 4 and 5, the cover, indicated in general at 26, has a top wall 74, a curvilinear first end 76, and a back wall 78 at a distal second end 80. The first end 76 of the cover 26 is curvilinear to align with the curved surface of the cylindrical end of the holder and to avoid interference with lock assembly 28 (FIGS. 1 and 2) as it is rotated when the lock assembly is unlocked.

As illustrated in FIG. 4, the cover 26 also has generally triangular sidewalls 82, 84 that are sized to cover at least a substantial portion of the exterior of the sidewalls of the holder 24. The cover back wall 78 also covers the second or distal end of the holder 24. In the illustrated embodiment, everything but the bottom and cylindrical end of the holder 24 is covered by cover 26 so that a child cannot extend his or her fingers between the holder 24 and the cover 26 when the cover is locked and the door handle is not being operated. With this configuration, it is impossible to grasp the holder 24 to rotate it. Only the cover 26 is accessible and it cannot be rotated, so as to rotate the holder 24 and open the door, unless it is unlocked.

Cover 26 has concave, circular edges 86 (FIGS. 4 and 2) and 88 (FIG. 2) positioned below the first end 76 of the cover 26. The two edges 86, 88 are spaced from and aligned with each other for respectively engaging, and rotating about, the extensions 50*a*, 50*b*, 52*a* and 52*b* of holder 24.

The first end 76 of top wall 74 of the cover 26 features an indent 90 that, as will be explained below, is engaged by lock assembly 28. The portion 150 of the top wall 76 forming the indent 90 is shallow so that it does not interfere with rotation of the holder 24.

Referring to FIG. 5, the lock assembly 28 has a lock housing 92 with a base plate 94 that is mounted on a door above the door handle. The base plate 94 has holes 152 for receiving screws 154 shown in FIG. 2 in phantom, but could be mounted to the door in any manner sufficient to hold the lock assembly 28 on the door, including other types of fasteners, adhesives, etc.

Figure 6:
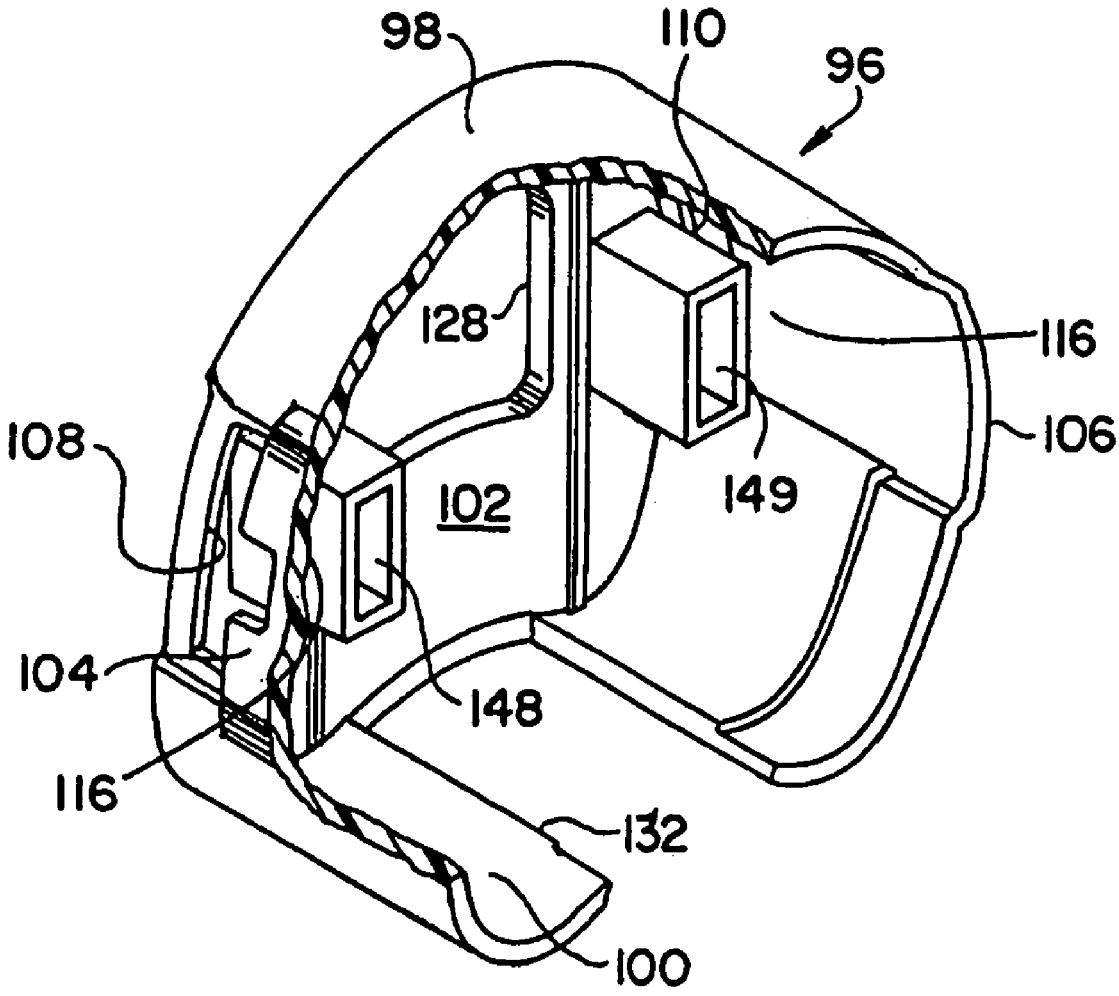
FIG. 6 is a back, perspective view of the cover of the lock assembly of FIG. 5.

As illustrated in FIGS. 5 and 6, the lock housing 92 also has a front cover 96 with a top wall 98, a bottom wall 100, a front wall 102 and sidewalls 104, 106. The sidewalls 104, 106 have slots 108, 110 for receiving tabs 112, 114 extending horizontally from edges of the base plate 94 to distal hooked-ends 156 and 157 to secure the front cover 96 to the base plate 94. The tabs 112, 114 are respectively positioned between interior walls 116, 117 and sidewalls 104, 106 to maintain the hooked ends of the tabs in slots 108, 110. It will be appreciated that while two tabs are shown, in the alternative more than two tabs may be used. Of course, many other ways of securing the front cover 96 to the base plate 94 without the use of tabs is also contemplated.

As illustrated in FIG. 5, a mounting plate 118 is placed between the base plate 94 and front cover 96. The mounting plate 118 has two vertical inner guide walls 120 and 121 that slide within outer guide walls 148 and 149 extending from the front cover 96 (shown on FIGS. 1 and 5). A horizontal stopper wall 122 (FIG. 5) also extends from the mounting plate 118 forming a portion of the bottom wall of the housing 92. As illustrated in FIG. 5, an activator 124 is positioned between the mounting plate 118 and the front cover 96. The activator 124 is slidably positioned between the outer guide walls 148 and 149 and has a button 126 extending through an aperture 128 formed in the front wall 102 of the front cover 96.

The activator 124 also has a downwardly extending, integrally formed latch 130 that extends through an aperture 132 formed in the bottom wall 100 of the housing 92. The stopper wall 122 of the mounting plate is positioned below a portion of the activator 124 behind the bolt 130. As a result, the stopper wall 122 prevents the activator from falling out of the bottom of the housing 92.

The activator 124 also has a cut-out 134 defining a seat 136 with an upward extending mounting pin 138 (FIG. 1) which aligns with a mounting pin 140 (FIG. 1) extending downward from the top wall 98 of the housing 92. A helical spring 142 has a lower end 144 engaging the seat 136 and mounted on the pin 138, and an upper end 146 engaging the pin 140. As illustrated in FIGS. 1 and 2, the spring biases the activator 124 downward and the bolt 130 out of the lock housing 92 through aperture 132, where it engages indent 90 of the cover 26.

In order to secure the locking assembly 28 above the cover 26, as illustrated in FIG. 1, the base plate 94 (FIG. 5) is first mounted on the door. The user then moves the front cover 96, within which the remaining components of FIG. 5 have been assembled, so that bolt 130 slides through indent 90 of the cover 26 until the front cover fully engages tabs 112, 114 securing the front cover 96 to the base plate 94. The indent 90 must be elongated to provide enough space for the bolt 130 to be received while the front cover 96 is vertically aligned with, and horizontally spaced from, the base plate 94 so that the tabs 156, 157 of the base plate 94 may be inserted into the front cover 96 for engagement with tabs 112, 114.

As shown in FIG. 1, the locking assembly 28 defaults to a locked position where bolt 130 is biased downward and engages indent 90, which prevents the cover 26 from being rotated, effectively preventing the opening of the door from the first side of the door. A child attempting to turn the handle from the first side of the door cannot move the holder 24 since it is covered by cover 26, and must attempt to rotate the handle by applying force on the locked cover 26.

Figure 7:
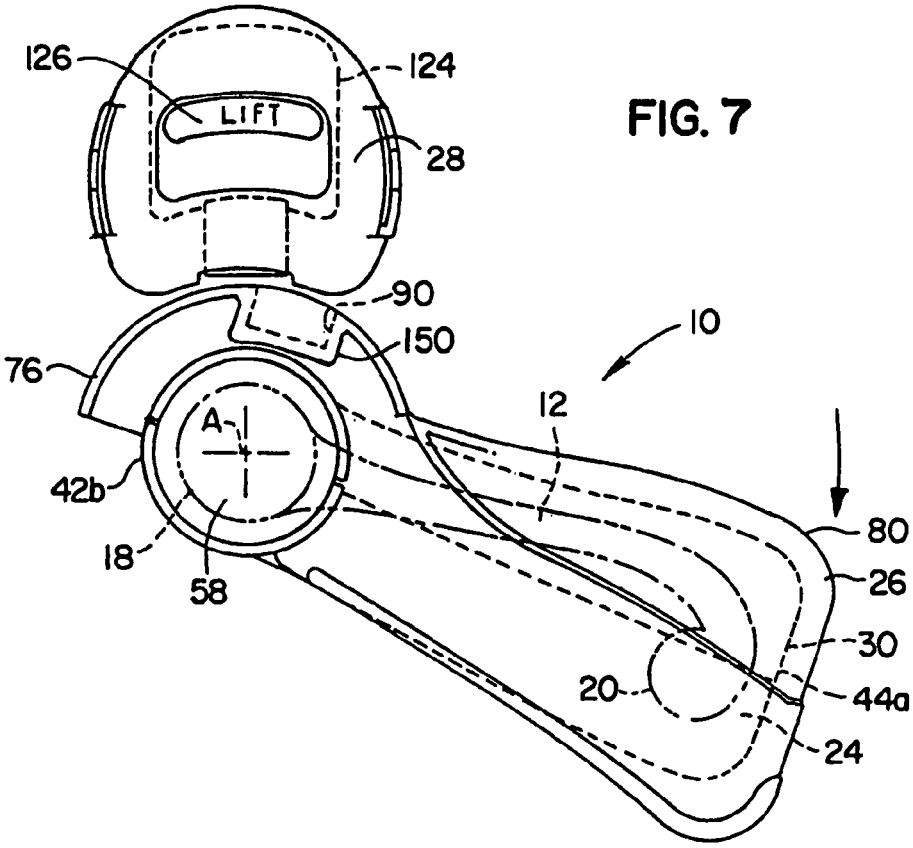
FIG. 7 is a front, elevational view of the child safety lock of FIG. 1 in an unlocked condition.

As shown in FIG. 7, lifting the button 126 on the lock assembly 28 upward compresses spring 142 (FIGS. 1 and 2) and moves the activator 124 upward. This action disengages bolt 130 from indent 90 permitting the cover 26, holder 24 and lever handle 20 to rotate clockwise when cover 26 is turned clockwise so that the door may be opened.

Figure 8:
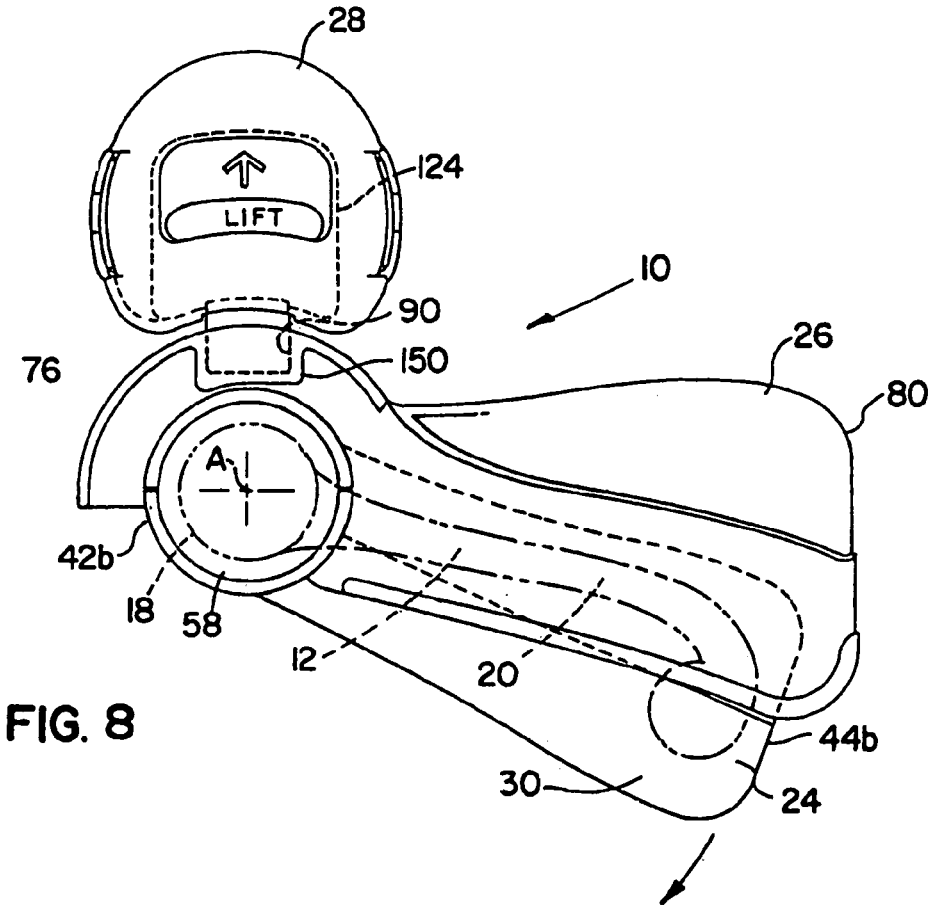
FIG. 8 is a front, elevational view of the child safety lock of FIG. 1 in a locked condition but operated from a second side of the door.

The door, however, can still be opened from the opposite or second side of the door even if the door handles on opposite sides of the door rotate together. As shown in FIG. 8, when a door knob or handle on the second side of the door is turned, the holder 24 is free to rotate clockwise and away from cover 26 since the lock assembly 28 only engages the cover 26 and not the holder 24. As a result, the door may be opened from the opposite or second side even though it is locked on the first side.

While some of the embodiments of the invention have been shown and described, it will be apparent to those skilled in the art that changes and modifications may be made therein without departing from the spirit of the invention, the scope of which is defined by the appended claims.

What is claimed is:

1. A child safety lock adapted to be secured to and for locking a lever door handle rotatably mounted on a first side of a door and biased in a first position, comprising:

a holder adapted to engage the door handle so that rotating the door handle rotates said holder;

a cover pivotally mounted on said holder and shaped to cover said holder; and a lock assembly adapted to be disposed in a vicinity of said cover, said lock assembly selectively engaging said cover for preventing rotation of said cover relative to the first side of the door while said holder is free to rotate with the door handle when the handle is operated from a second side of the door.

2. The child safety lock of claim 1, wherein said holder has an elongated body with a generally cylindrical first end, a distal second end, and sidewalls extending in a direction from said first end to said second end, and wherein said cover has a first end, a second end, and sidewalls that cover at least a substantial portion of the exterior of said sidewalls of said holder.

3. The child safety lock of claim 2, wherein said sidewalls of said cover define opposing, spaced concave grooves for respectively engaging the cylindrical first end of said holder.

4. The child safety lock of claim 1, wherein said cover includes an indent and said lock assembly includes a lock housing with an aperture formed therein, said lock housing containing a spring and a sliding activator, said activator including a button extending through the aperture and a latch, said spring biasing the latch to extend out of the lock housing to engage the indent of the cover.

5. The child safety lock of claim 1, wherein said lock assembly includes a lock housing disposed above said cover and a latch slidably disposed in said lock housing, and wherein said cover has a top wall defining an elongated indent for selectively receiving said latch.

6. The child safety lock of claim 5, wherein said lock housing has a base plate mounted on the door with at least one generally, horizontally extending locking tab, and a front cover with a wall defining at least one slot for receiving said locking tab, said bolt extending out of said front cover of said lock housing, and wherein said indent on said top wall of said cover is sufficiently elongated in a direction parallel to an axis of rotation of said door handle for providing space for movement of said bolt when said front cover is being aligned with said base plate.

7. The child safety lock of claim 2, wherein said first end of said cover has a curvilinear surface to avoid interference with said lock assembly as it is being rotated.

8. A child safety lock adapted to be secured to and for locking a lever door handle rotatably disposed on a first side of a door, the lever door handle including a shank extending from the door and an elongated lever member extending from a distal end of the shank, the child safety lock comprising:

a holder adapted to enclose at least a substantial portion of the lever member;

a cover pivotally mounted on said holder and shaped to cover said holder; and a locking mechanism adapted to be disposed on the door and engaging said cover for selectively preventing rotation of said cover relative to and from the first side of the door while said holder is free to rotate with the door handle when operated from a second side of the door.

9. The child safety lock of claim 8, wherein said cover includes an indent and said lock assembly includes a lock housing with an aperture formed therein, said lock housing containing a spring and a sliding activator, said activator including a button extending through the aperture and a latch, said spring biasing the latch to extend out of the lock housing to engage the indent of the cover.

10. The child safety lock of claim 8, wherein said holder encloses the entire lever member.

11. The child safety lock of claim 8, wherein said holder includes an elongated housing with a first generally cylindrically shaped end and an opposing distal second end, said cylindrical end having two opposing circular openings.

12. The child safety lock of claim 11, wherein said holder includes a key-hole cap and wherein either said opening of said cylindrical end receives said shank of the door handle and either said opening removably receives said cap so that the holder is adaptable to alternatively fit on either a left-hand or a right-hand lever handle.

13. The child safety lock of claim 8, wherein said holder includes a housing with a first end, an opposing second end, and two interlocking, elongated halves extending from said first end to said second end.

14. The child safety lock of claim 13, wherein said halves have locking tabs received by, and engaging, locking slots at said first and second ends of said holder for securing said halves to each other.

15. The child safety lock of claim 13, wherein said halves respectively fit over the top and bottom of the lever member.

16. The child safety lock of claim 8, wherein said holder has at least one cushion pad adapted to be placed between the door handle and an interior surface of the holder for providing a snug fit between the holder and the door handle.

17. A child safety lock adapted to be secured to and for locking a lever door handle rotatably disposed on a first side of a door with first and second opposing sides, comprising:

a holder having a housing adapted to enclose the door handle on the first side of the door;

locking means for selectively preventing rotation of the holder and door handle by an attempt to rotate the door handle from the first side of the door; and rotation means for permitting rotation of the door handle on the first side of the door by operation of the door handle from the second side of the door while said locking means is locked, said rotation means including a cover mounted on said handle and shaped to cover and engage said holder so that said cover must be rotated in order to rotate said holder in order to operate said door handle from the first side of the door but wherein said holder is free to rotate away from said cover when said door handle is operated from the second side of the door.

18. The child safety lock of claim 17, wherein said locking means is disposed in a vicinity of said cover and has a retractable bolt and said cover has a top surface defining an indent for receiving said bolt.

19. A child safety lock adapted to be secured to and for locking a lever door handle rotatably disposed on a first side of a door with first and second opposing sides, comprising:

a holder having a housing adapted to enclose the door handle on the first side of the door;

locking means for selectively preventing rotation of the holder and door handle by an attempt to rotate the door handle from the first side of the door;

rotation means for permitting rotation of the door handle on the first side of the door by operation of the door handle from the second side of the door while said locking means is locked, said rotation means including a cover disposed over said holder, and said locking means including a lock housing, a retractable bolt slidably mounted on said lock housing, and a spring biasing said bolt to extend out of said lock housing, said lock housing being disposed on said door where said bolt selectively engages said cover.

* * * * *